United States Patent [19]

Kirk et al.

[11] 4,198,266

[45] Apr. 15, 1980

[54] OXYGEN DELIGNIFICATION OF WOOD PULP

[75] Inventors: Bradley S. Kirk, Warren; Mark J. Kirschner, West Orange, both of N.J.

[73] Assignee: Airco, Inc., Montvale, N.J.

[21] Appl. No.: 841,263

[22] Filed: Oct. 12, 1977

[51] Int. Cl.[2] ..... D21C 3/02

[52] U.S. Cl. ..... 162/29; 162/49; 162/57; 162/62; 162/65

[58] Field of Search ..... 162/49, 57, 29, 62, 162/65

[56] References Cited

U.S. PATENT DOCUMENTS

| | | | |
|---|---|---|---|
| 3,251,730 | 5/1966 | Watanabe | 162/65 |
| 3,754,417 | 8/1973 | Jamieson | 162/65 |
| 3,826,742 | 7/1974 | Kirk et al. | 210/63 |
| 3,832,276 | 8/1974 | Roymoulik et al. | 162/65 |
| 3,843,473 | 10/1974 | Samuelson et al. | 162/65 |
| 3,941,649 | 3/1976 | Wallin | 162/49 |
| 3,944,463 | 3/1976 | Samuelson et al. | 162/65 |
| 3,951,733 | 4/1976 | Phillips | 162/65 |

FOREIGN PATENT DOCUMENTS

| | | | |
|---|---|---|---|
| 929711 | 7/1973 | Canada | 162/65 |

OTHER PUBLICATIONS

TAPPI vol. 59, No. 11, 11/76, pp. 77–79.

*Primary Examiner*—S. Leon Bashore
*Assistant Examiner*—William F. Smith
*Attorney, Agent, or Firm*—David L. Rae; Larry R. Cassett; Edmund W. Bopp

[57] ABSTRACT

In a process for delignifying wood pulp with oxygen, a pulp slurry and oxygen are introduced into an elongated reactor having a plurality of gravitational fall zones at which oxygen is dissolved in the liquid phase of the slurry. The length of the reactor is sufficient to provide the residence time required for delignification reactions. Alkali is added in controlled quantities along the reactor length in response to sensed slurry pH to maintain a predetermined slurry pH throughout the reactor. The oxygen treated slurry discharged from the reactor is separated into pulp and hot recycle liquor, the latter being utilized to effect thermal, chemical and water economies.

3 Claims, 4 Drawing Figures

OXYGEN DELIGNIFICATION OF WOOD PULP

BACKGROUND OF THE INVENTION

The present invention relates to methods of delignification of wood pulp and more particularly, to improvements in alkaline-oxygen delignification of wood pulp.

Processes for producing paper include a pulping stage in which a major part of delignification is realized. A subsequent bleaching stage is utilized in the production of white paper. In this latter stage, the delignification process is continued and results in the purification of cellulose fibers which is necessary in the production of white or dyed paper. In bleaching processes designed to enable production of such paper, lignin content in the pulp is reduced by molecular fragmentation and/or dissolution while degradation of cellulose is avoided as far as possible. However, although a "whiteness" bright to the eye is to be developed by bleaching, other characteristics such as tensile strength, burst, folding endurance, etc., and brightness stability must also be maintained.

Bleaching of wood pulp is comprised of a sequence of steps designed to (1) prepare pulp for solution of ligneous compounds not previously dissolved by chemically fragmentizing lignin polymer, (2) dissolve fragmentized lignin, and (3) develop brightness in the pulp by using oxidative decolorizing reagents. The first step is often attained by chlorination, the second by 'extraction' with alkaline solution and the third by using hydrogen peroxide, chlorine dioxide, hypochlorite, etc. Although the number and nature of such stages will vary in different bleaching sequences, the above functions must be performed to achieve final paper strength and brightness characteristics.

Widespread usage of chlorine for lignin removal has resulted from the excellent specificity of chlorine for lignin, and the rapidity of reactions results in only minimal attack on carbohydrates, i.e. cellulose. Although the foregoing attributes of chlorination stages facilitate pump bleaching, substantial quantities inthe form of color, BOD (biological oxygen demand), COD (chemical oxygen demand) and chlorides are contained in the effluent of bleaching stages. While such effluents have previously been simply discharged to streams, lakes, etc., environmental statutes and regulations now severely restrict the permissible quantities and concentrations of such pollutant containing discharges. Furthermore, it has been found that effluent of the extraction stage following a chlorination stage also contains substantial quantities of color BOD, COD, chlorides and toxic chlorinated organic compounds, the discharge of which into natural bodies of water is obviously highly undesirable and generally prohibited by environmental codes and regulations.

In order to treat the pollutants noted above from a bleaching sequence, it has been proposed to utilize (a) lime precipitation to remove color, (b) aerated oxidation lagoons to lower BOD and (c) demineralization to eliminate chlorides. However, these treatment stages result in increased capital costs of a given bleaching sequence as well as higher operating costs.

As a partial or even complete alternative to chlorine and caustic extraction stages of a bleaching sequence, oxygen has been utilized to render lignin soluble in an alkaline solution to thereby effect pulp delignification. The advantages of oxygen delignification are seen to reside in reduced levels of pollutant discharge, and the avoidance or reduction in production of chlorinated organic compounds. Additionally, there is a reduction in energy required to refine an oxygen pulp for paper making. Oxygen delignification processes are generally classified as either a high or low consistency type. In the former, dry pulp fibers comprise at least 20% of the moist pulp or slurry, while in the latter, dry pulp fibers comprise less than approximately 5% of such slurry. It is also known to delignify pulp in a medium consistency slurry comprised of approximaterly 6–15% dry pulp fibers.

In a high consistency oxygen delignification process, pulp fibers are covered with a thin film or layer of an alkaline solution which is permeated by oxygen gas. The reaction rate is determined by the result of such permeation or gas diffusion. In essence, fibers bearing an alkaline film are virtually "fluffed" in a reaction zone containing oxygen gas. The high consistency oxygen delignification process is not without its disadvantages, including high capital costs. Also, the availability of oxygen can lead to scorching or fiber degradation which is minimized by limiting the extent of oxygen delignification to about a 50% Kappa Number, reduction.

In low consistency oxygen delignification processes, oxygen is present as a dissolved material in the alkaline solution. A generally more uniform, higher quality pulp is producible by low consistency processes. However, such processes have heretofore required extensive agitation due to difficulties of dissolving oxygen in alkaline solutions. The solubility of oxygen in alkaline solutions is relatively low and it has been found that dissolved oxygen levels increase with increased rates of fluid agitation and surface exposure to gaseous oxygen.

Accordingly, a clear need exists for oxygen pulp delignification processes, which avoids the necessity of chlorine for delignification but which enable production of final pulp products having desired physical characteristics without incurring increased overall process and capital costs.

OBJECTS

It is an object of the present invention to provide improved processes for the oxygen delignification of wood pulp.

It is another object of the present invention to provide improved processes for oxygen delignification of low consistency wood pulp wherein final pulp products exhibit improved strength characteristics.

It is a further object of the present invention to provide improved oxygen pulp delignification processes having improved thermal and water economies. It is still another object of the present invention to provide improved low consistency, oxygen pulp delignification processes with minimal capital costs for equipment necessary to practice such processes.

It is yet another object of the present invention to provide improved methods of oxygen delignification of low consistency pulp wherein lower discharge of pollutant and toxic effluents requiring further treatment is attained.

It is a still further object of the present invention to provide improved methods of oxygen delignification of wood pulp wherein conventional chlorination and extraction stages of a multistage sequence are eliminated while acceptable strength properties are maintained.

It is an additional object of the present invention to provide improved methods for oxygen delignification of low consistency pulp wherein significant cellulose degradation occasioned by extended contact with concentrated alkali solutions is substantially prevented.

Other objects of the present invention will become apparent from the detailed description of an exemplary embodiment thereof which follows and the novel features of the present invention will be particularly pointed out in conjunction with the claims appended hereto.

SUMMARY

In accordance with the present invention, a method for oxygen delignification of wood pulp comprises the steps of mixing pulp with a liquor containing water, recycled liquor, and alkali to form a slurry; passing said slurry serially through a plurality of oxygen dissolution stages while injecting oxygen into one or more of such stages to thereby delignify pulp in said slurry, sensing the slurry pH in one or more of said stages and maintaining a substantially constant set of pH values within the range of 10–12.5 in the slurry during its passage through such stages. The slurry pH may be maintained at a single, predetermined value throughout all stages of the dissolution device or the pH of slurry in one stage may be maintained at a predetermined value which differs from the pH of slurry in other stages. The mixture which is formed in a suitable mixing vessel is preferably heated by steam prior to passage through the oxygen dissolution stages which may comprise an elongated pipeline reactor having a plurality of gravitational fall zones disposed therein or a plurality of 'mechanical' mixing stages. Oxygen gas may be injected in controlled amounts at one or more of the fall zones or mixing stages. The pH may be sensed at various locations along the reactor length, e.g. at different oxygen dissolution stages, such that controlled quantities of alkali may be supplied to one or more of the fall zones or stages to thereby maintain slurry pH at a substantially constant value in the foregoing range. Excess, undissolved oxygen gas may be vented from the delignified pump mixture which is preferably separated into pulp and hot recycled liquor. By returning such hot recycled liquor to the mixing vessel, both thermal, chemical, and water economies may be effected. Furthermore, by maintaining a pH at substantially constant, predetermined values more selective reactions will occur thereby resulting in a pulp which exhibits improved physical properties.

BRIEF DESCRIPTION OF THE DRAWING

The invention will be more clearly understood by reference to the following description of an exemplary embodiment thereof in conjunction with the following drawing in which.

DESCRIPTION OF PREFERRED EMBODIMENT

Before describing apparatus for practicing the method according to the present invention, it is considered helpful to keep in proper perspective certain attributes of pulp slurry. The method according to the invention is directed to the oxygen delignification of wood pulp which may be a low consistency pulp, e.g. approximately 2–5% dry pulp fibers. Although the fiber content of low consistency pulp is, of course, relatively low on a weight basis, the pulp itself is essentially thixotropic and must be handled with care, in addition to being a 'fluid' in which oxygen is relatively insoluble. Therefore, although certain attempts have been made to delignify low consistency pulp, relatively expensive capital equipment has been required and accordingly, one objective of such processes, the use of low cost capital equipment tends to be eroded. In accordance with the present invention, apparatus is provided for enabling the dissolution of oxygen in low consistency pulp slurry in a reactor having a plurality of stages and for maintaining the pulp liquor at a substantially constant pH throughout the entire delignification process, i.e. passage of slurry through all stages of the reactor.

It will be understood that although reference is made herein to "slurry pH", it is of course the liquid phase of the slurry which exhibits a given pH.

Figure 1:
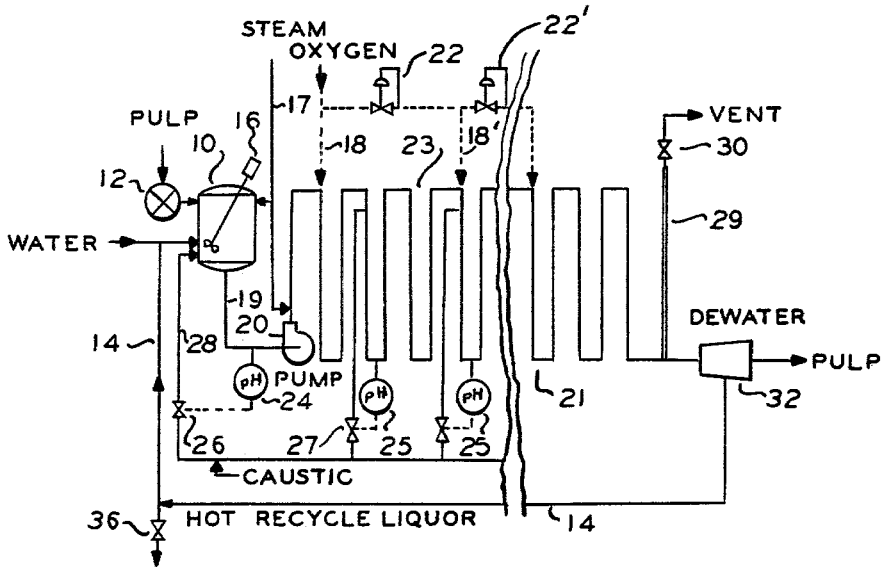
FIG. 1 is a schematic view of apparatus for enabling oxygen delignification of low consistency pulp by the method according to the present invention.

Referring now to FIG. 1, illustrated therein is an exemplary embodiment of apparatus for enabling oxygen delignification of low consistency pulp and comprising a mixing vessel 10, oxygen dissolution device or reactor 21, a dewatering device 32, means 24–27 for controlling the pH of pulp slurry flowing through device 21 as well as necessary conduits and valves. Mixing vessel 10 is adapted to receive a flow of pulp higher than 5% consistency (preferably at least 15%) from a suitable feeding device 12 together with water and/or recycled liquor supplied to conduit 14 and steam supplied thereto through conduit 17. A charge of caustic (alkali) is also supplied to vessel 10 through valve 26 and conduit 28. The low consistency pulp slurry formed in vessel 10 is passed therefrom through conduit 19 to pump 20 from which the slurry is passed through stages of dissolution device 21. Preferably, steam is added to the slurry just downstream of pump 20 to establish necessary process temperatures in the range of 90°–160° C. Furthermore, oxygen is supplied through conduit 18, 18' and pressure regulating devices 22, 22', etc. to a plurality of stages in dissolution device 21 which will now be described in somewhat greater detail.

Multistage dissolution device 21 is preferably comprised of an elongated reactor or pipeline having a plurality of gravitational fall zones disposed therein. Such a dissolution device is described in U.S. Pat. No. 3,826,742 which is assigned to the assignee of the present invention. Each stage of dissolution device 21 is essentially comprised of an inverted U-shaped pipe segment and as pulp liquor undergoes a gravitational fall in the downleg of each such U-shape segment, the pulp liquor is rendered turbulent. By injecting oxygen into dissolution device 21 as described in the aforementioned U.S. Patent, a gas pocket or region will be established at each downleg or gravitational fall zone of the device and consequently, the pulp slurry is contacted with oxygen gas which is dissolved therein. Oxygen gas which is not dissolved as a consequence of contacting the turbulent pulp slurry will, as larger bubbles, rise and return to the gas pocket or as smaller bubbles are swept downward through one stage of dissolution device 21 and will be carried to the next stage or fall zone for contact with and dissolution in the pulp slurry. Consequently, by utilizing a pipeline reactor having a plurality of gravitational fall zones disposed therein as illustrated in the drawing, it is unnecessary to inject oxygen into each and every stage of dissolution device 21. Accordingly, as oxygen gas which is not dissolved in the pulp slurry at one stage is available for dissolution at a later stage so that highly efficient use of oxygen gas and correspondingly low losses thereof occur upon injection of such gas into different stages of dissolution device 21. Typically, oxygen is injected into various stages of dissolution device 21 under pressures of approximately 50 psig and consequently, ordinary standard piping may be utilized as compared with materials designed to withstand significantly greater pressures. The residence time of slurry in device 21 will be determined by the number of stages, flow rate and consistency of the slurry flowing therethrough. Typically, a residence time of 15–30 minutes of low consistency pulp in dissolution device 21 has been adequate to enable sufficient delignification of pulp fibers. By providing pressure regulators 22, 22', etc. oxygen may be supplied to dissolution device 21 on a demand basis, i.e. as oxygen is dissolved into the pulp slurry, the amount thereof at a particular fall zone will decrease as will the gas pressure at such fall zone and consequently, regulators 22, 22' will be opened to provide additional, makeup oxygen to the fall zone. In this manner, the supply of oxygen to dissolution device 21 may be efficiently controlled. It will be understood that device 21 may be comprised of a plurality of 'mechanical' dissolution stages and a corresponding number of alkali injection devices.

In accordance with the present invention, the pH of pulp slurry being passed through multistage dissolution device 21 is controlled at a substantially constant value or values within the range of approximately 10–12.5. It has been found that due to bicarbonate/carbonate formation and organic acid salts, a buffering effect will prevent establishment of pH values of pulp liquor above 12.5 while delignification will not proceed rapidly and efficiently in alkaline solutions having a pH below approximately 10.0 Furthermore, it has been found that by controlling the pH of pulp slurry at a value of approximately 11.0, improved physical properties will be obtained. In order to so control the pH of pulp slurry, a pH sensing device 24 is adapted to sense the alkalinity of the pulp slurry passed from mixing vessel 10 to pump 20 and is effective to control the setting of valve 26 through which alkali is supplied to mixing vessel 10. In this manner, the pH of the pulp slurry may be set at a predetermined value of, for example, 11.0 before passage of such liquor to multistage dissolution device 21. In the course of passage of pulp slurry through device 21, oxygen dissolved in the pulp slurry will tend to break down or fragment the lignin and produce organic acids, diacids and carbon dioxide which in turn tends to reduce the pH of the pulp slurry. In prior art oxygen delignification processes, alkali is simply introduced in a reaction vessel or the like in such a quantity so as to assure that by the end of a predetermined time period, the desired degree of delignification will be attained. However, this results in a relatively high pH or active alkali being initially established in such a reaction vessel and corresponding cellulose degradation. In accordance with the present invention, however, pH sensing devices 25 are adapted to sense the pH of slurry in various stages of multistage dissolution device 21 and are effective to control valves 27 and hence the rate at which alkali is injected into individual stages, or gravitational fall zones, of device 21. In this manner, the pH of the slurry may be maintained at a substantially constant value regardless of at which stage of device 21 the slurry happens to be. Consequently, more selective reactions occur and as will be described, improved pulp characteristics may be obtained. It should be noted that by controlling pH to a predetermined value or values within the range of 10–12.4, the aforementioned problems of excessive and insufficient pH noted in connection with prior art pulp delignification processes are avoided.

Waste gas will be separated from pulp liquor discharged from device 21 and such waste gas may be vented through conduit 29 and valve 30 to atmosphere. A dewatering device 32 is provided to separate delignified pulp and hot recycled liquor or filtrate, the latter being returned to mixing vessel 10 through conduit 14 or discharged through valve 36 to a waste collection system. By so returning hot recycled liquor to vessel 10, theremal, chemical and water economies will be obtained although discharge of such liquor through valve 36 will not present undue burdens upon waste collection systems and as mentioned above, will not present any danger of toxicity as a chlorine stage may be deleted upon utilization of the method according to the present invention. Typically, the flow rate of hot recycled liquor may be on the order of 80% or more of the flow rate of the liquid used to prepare the pulp slurry. That portion of the liquor that is not recycled, i.e. that which is contained in the separated pulp can ultimately be consumed by the liquor recovery system of the plant. This can be accomplished by containing the oxygen filtrate in the brown stock washing or in other portions of the pulp mill. In this manner, the pulp mill effluent loading will be reduced.

The method according to the present invention has been experimentally tested in a pilot plant which included approximately 100 ft. of 4-in. diameter pipe having three gravitational fall zones. An open tank was utilized for making a low consistency pulp slurry with the tank outlet connected to the pipe. A centrifugal pump located downstream of the third gravitational fall zone was utilized to circulate low consistency pulp slurry throughout the pilot plant system. Oxygen gas was supplied from a gas cylinder to the first gravitational fall zone and alkali, supplied from a tank having a sight tube level gage, was also introduced into the pilot plant at the first gravitational fall zone. A vent leg was provided at the outlet of the makeup tank to enable vented gas quantities and oxygen concentration to be analyzed while suitable flow meters were provided to measure the quantity of oxygen and alkali supplied. A pulp sampling device was located downstream of the pump outlet to enable 600 ml. pulp samples to be periodically taken.

The pulp which has been delignified in the pilot plant described above consisted of bleachable grades of kraft pulp of mixed southern softwoods. Raw pulp having a Kappa No. of 27.5 was mixed with 80% recycled liquor and water to make a pulp slurry of approximately 3% consistency. This low consistency pulp formed in the makeup tank was heated to a temperature between 90°–140° C. and for each particular run, the temperature was maintained substantially constant. Samples of pulp were taken at periodic intervals throughout operation of pilot plant runs and the pH of the low consistency pulp slurry was continuously monitored and held at a predetermined value of 10, 11 or 12 in any given run. In certain runs, the pH was uncontrolled and this was accomplished by merely introducing an alkali charge into the first gravitational fall zone at the initiation of a particular run with no further additions being made. Oxygen partial pressure was maintained at approximately 30 psia and no attempt was made to optimize oxygen consumption. Although the majority of the pipeline length was maintained in an insulated cabinet, a heating cable was utilized to maintain the foregoing constant temperature essentially throughout the overall length of the pipeline reactor.

Figure 2:
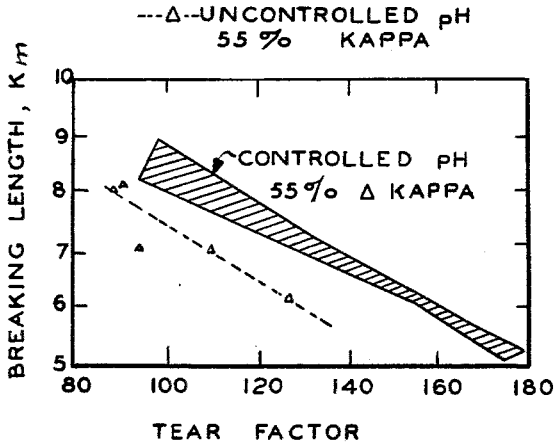
FIGS. 2 and 3 are graphical representations of various physical characteristics of pulp treated with the method according to the invention and by prior art processes.
Figure 3:
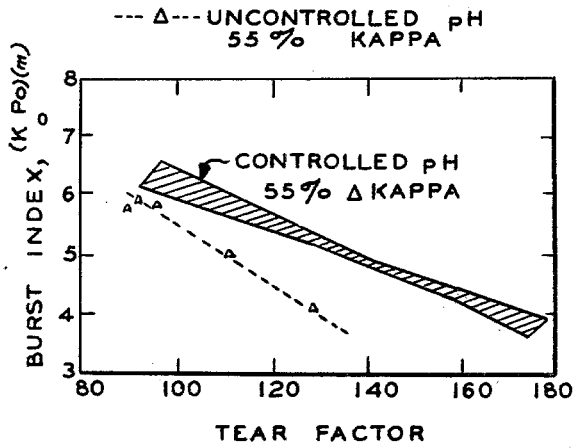

Throughout several runs of this pilot plant on the pulp slurry mentioned above, an average specific oxygen consumption of approximately 2.2 g/kg. O.D. pulp-/Kappa number reduction was obtained while alkali consumption averaged approximately 2.3 g/kg. OD pulp/Kappa number reduction. Subsequent to the delignification of the above identified low consistency pulp, delignified pulp was refined to several different degrees of freeness in the range of 300–700 CSF (Canadian Standard Freeness) and certain standard pulp characteristics were measured. These characteristics included breaking length, tear factor, and burst index for 55% oxygen delignification during 15 min. treatment with both controlled and uncontrolled pH values. Referring now to FIG. 2, illustrated therein is a graphical representation of breaking length versus tear factor for identical samples of the aforementioned low consistency pulp subjected to 55% delignification (Kappa number reduction) with both controlled pH and uncontrolled pH. The shaded area indicates a range of points with pH being controlled at either 10, 11 or 12 and as will be seen in FIG. 2, greater physical properties have been found to result for a 55% Kappa number reduction with controlled pH than with uncontrolled pH as is common to prior art oxygen delignification processes. A similar plot of burst index versus tear factor is illustrated in FIG. 3 for both controlled and uncontrolled pH runs resulting in a 55% Kappa number reduction. Again, increased burst index and tear factors both result from oxygen delignification of low consistency pulp with controlled pH as compared with the same degree of delignification with uncontrolled pH. Thus, not only does the method according to the present invention enable the efficient dissolution of oxygen in a low consistency pulp but by additionally maintaining the pH of such pulp at a constant value throughout the delignification reactions, improved pulp characteristics such as breaking length and burst index have been observed upon subsequent refining of such delignified pulp.

Figure 4:
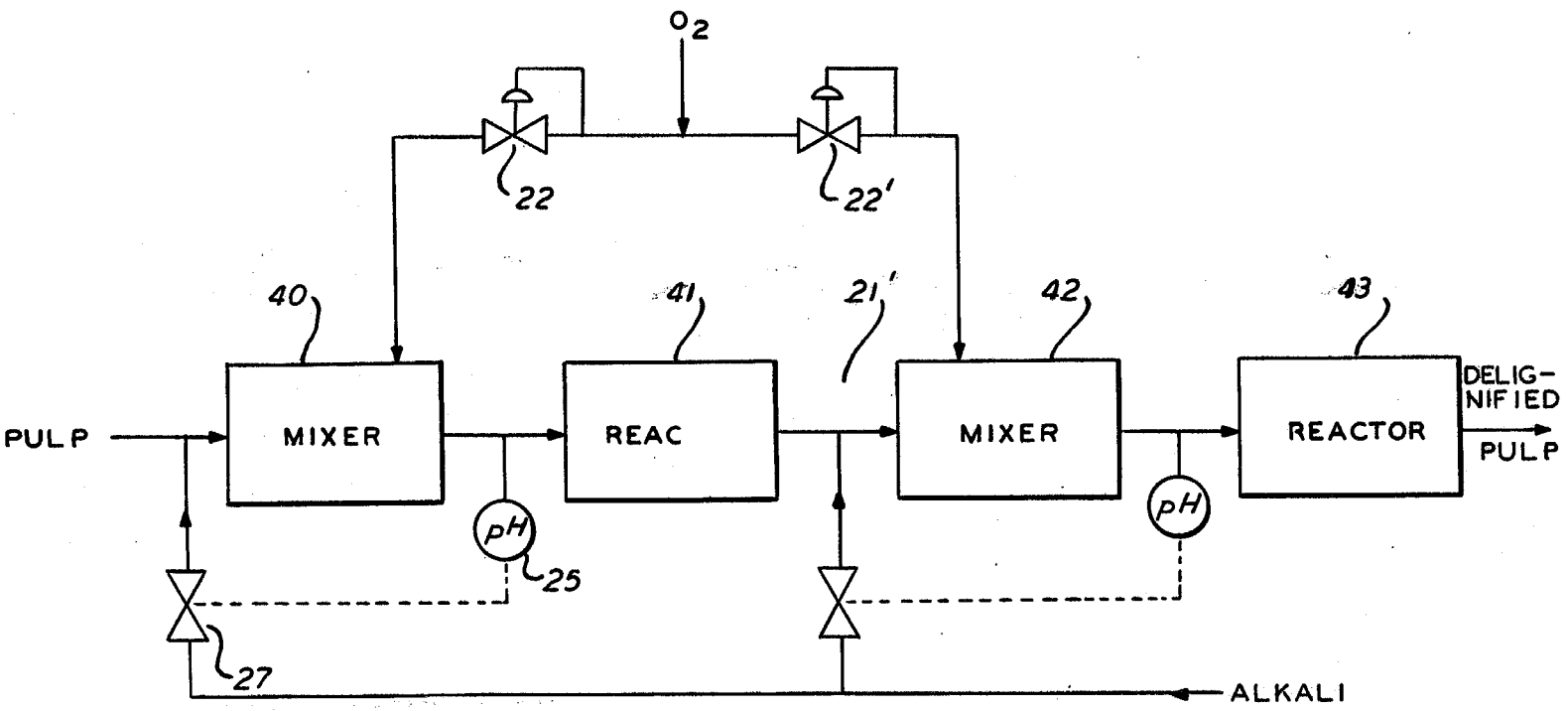
FIG. 4 is a schematic view of a further embodiment of apparatus for practicing the method according to the present invention.

Referring now to FIG. 4, illustrated therein is a schematic diagram of device 21' for delignifying "medium" consistency pulp in accordance with the present invention. Although the aforedescribed use of gravitational fall type dissolution devices are preferred for delignification of low consistency pulp, controlled alkali additions may be exploited to delignify "medium" consistency pulp, i.e. 5–15% dry pulp fibers. Mixing stages 40 and 42 which may comprise mechanical devices for generating high shear forces in pulp therein are adapted to receive controlled flows of oxygen gas through regulators 22 and 22', respectively. Reactors 41 and 43, which may comprise holding tanks or even pipelines are provided to receive pulp from mixing stages 40 and 42. Retention of such pulp, which is preferably of a consistency of between approximately 5–15%, in reactors 41 and 43 for a total period of about 10–30 minutes will be adequate to enable delignification reactions to occur.

The pH of the pulp slurry may be sensed by devices 25 at a plurality, and even all, stages of the apparatus depicted in FIG. 4 with the supply of alkali to each such stage being controlled by adjustment of valves 27 in response to sensed pH as mentioned heretofore. Thus, a substantially constant predetermined pH is maintained in each stage of dissolution device 21', although the actual pH of slurry in one stage may differ from the pH of slurry in other stages. For example, it may be expedient to establish a lower pH in reactor 41 than exists in reactor 43 of dissolution device 21'.

It will be understood that delignification of wood pulp by the method according to the invention may be effected in an oxygen pulping and/or oxygen bleaching stage of a pulp mill and pulp or low or medium consistency may be effectively delignified.

Although automatic, feedback pH control systems have been illustrated in FIGS. 1 and 4, it will be appreciated that such systems are not absolutely necessary to maintain a substantially constant slurry pH in dissolution devices 21 and 21'. For example, fixed alkali feed rates based on constant slurry conditions may be set and manual valves may be operated to add alkali at multiple points of dissolution devices 21 or 21'. Thus, under constant conditions, the slurry pH need not be continuously measured or sensed.

Furthermore, it will be understood that although alternate mixer-reactor units are illustrated in FIG. 4, a series of mixing stages having enough volume to assure slurry detention periods adequate to enable delignification reactions to occur therein may also be utilized. The slurry flow through such a 'stage mixed reactor' will approximate plug flow.

It will be understood that the foregoing and other changes in form and details may be made without departing from the spirit and scope of the present invention. Consequently, it is intended that the appended claims be interpreted as including all such changes and modifications.

What is claimed is:

1. A method of treating a liquid-solid mixture including the steps of passing said mixture through an elongated pipeline reactor having a plurality of gravitational fall zones disposed therein, introducing oxygen gas under superatmospheric pressure into said reactor to establish a gas space at each fall zone with the turbulence imparted to the mixture falling through the gas space at each fall zone resulting in a dissolution of oxygen in the liquid phase of the mixture, the improvement comprising the steps of:

forming said mixture as an essentially thixotropic pulp slurry comprised of at least 2% fibers by introducing pulp, recycle liquor and alkali in a mixing vessel, heating said slurry to a temperature in the range of about 90–160° C; passing said pulp slurry through said reactor in essentially plug flow, whereby oxygen is dissolved in the liquid phase of said slurry at each gravitational fall zone while delignification reactions occur as the slurry is passed through the reactor from one gravitational fall zone to the next; sensing the actual slurry pH at a plurality of said gravitational fall zones of the reactor; adding alkali at said plurality of said gravitational fall zones in response to sensed pH to mix alkali and slurry so that a substantially constant slurry pH between approximately 10.0 and 12 is maintained at each said gravitational fall zone; discharging the delignified pulp slurry from the reactor; separating said slurry discharged from the reactor into pulp and recycle liquor; and returning said recycle liquor to said mixing vessel.

2. The method as defined in claim 1 wherein said pulp is a low consistency pulp slurry having approximately 2–5% by weight of pulp fibers.

3. The method as defined in claim 1 wherein said pulp is a medium consistency pulp slurry having approximately 6–15% by weight of pulp fibers.

* * * * *